US008152451B2

(12) United States Patent
Manteiga et al.

(10) Patent No.: US 8,152,451 B2
(45) Date of Patent: Apr. 10, 2012

(54) SPLIT FAIRING FOR A GAS TURBINE ENGINE

(75) Inventors: John Alan Manteiga, North Andover, MA (US); Wilhelm Hernandez, Lynn, MA (US); Thet Kwan, Peabody, MA (US); Patrick Murphy, Kensington, NH (US)

(73) Assignee: General Electric Company, Schenectady, NY (US)

( * ) Notice: Subject to any disclaimer, the term of this patent is extended or adjusted under 35 U.S.C. 154(b) by 712 days.

(21) Appl. No.: 12/325,173

(22) Filed: Nov. 29, 2008

(65) Prior Publication Data

US 2010/0135777 A1 Jun. 3, 2010

(51) Int. Cl.
*F01D 9/04* (2006.01)
*F01D 5/18* (2006.01)

(52) U.S. Cl. ..... 415/115; 415/190; 416/189

(58) Field of Classification Search ..... 415/115, 415/116, 209.3, 209.4; 416/195, 191, 189, 416/214 R, 214 A, 232; 29/889.21, 889.72, 29/889.721, 889.722
See application file for complete search history.

(56) References Cited

U.S. PATENT DOCUMENTS 4,793,770 A * 12/1988 Schonewald et al. ..... 415/190
4,993,918 A * 2/1991 Myers et al. ..... 415/191
5,272,869 A 12/1993 Dawson et al.
5,284,011 A 2/1994 Von Benken
5,292,227 A 3/1994 Czachor et al.
5,356,264 A 10/1994 Watson et al.
5,357,744 A 10/1994 Czachor et al.
5,438,756 A 8/1995 Halchak et al.
5,483,792 A 1/1996 Czachor et al.
5,634,767 A 6/1997 Dawson
5,851,105 A 12/1998 Fric et al.
6,290,463 B1 * 9/2001 Fargher et al. ..... 416/97 R
6,358,001 B1 3/2002 Bosel et al.
6,439,841 B1 8/2002 Bosel
6,447,248 B1 9/2002 Kastl et al.
6,612,807 B2 9/2003 Czachor
6,672,833 B2 1/2004 MacLean et al.
6,708,482 B2 3/2004 Seda
6,719,524 B2 * 4/2004 Nguyen et al. ..... 415/1
6,796,765 B2 9/2004 Kosel et al.
6,860,716 B2 3/2005 Czachor et al.
6,883,303 B1 4/2005 Seda
6,935,837 B2 8/2005 Moniz et al.
6,983,608 B2 1/2006 Allen, Jr. et al.
7,008,185 B2 * 3/2006 Peterman et al. ..... 416/96 A
RE39,479 E * 1/2007 Tressler et al. ..... 415/115
7,353,647 B2 4/2008 Orlando et al.

* cited by examiner

*Primary Examiner* — Benjamin Sandvik
*Assistant Examiner* — Joseph Schoenholtz
(74) *Attorney, Agent, or Firm* — David J. Clement, Esq.; Trego, Hines & Ladenheim, PLLC

(57) ABSTRACT

A fairing for a structural strut in a gas turbine engine includes: (a) an inner band; (b) an outer band; (c) a hollow, airfoil-shaped vane extending between the inner and outer bands; (d) wherein the fairing is split along a generally transverse plane passing through the inner band, outer band and vane, so as to define a nose piece and a tail piece; and (e) complementary structures carried by the nose piece and the tail piece adapted to secure the nose piece and the tail piece to each other.

15 Claims, 10 Drawing Sheets

SPLIT FAIRING FOR A GAS TURBINE ENGINE

STATEMENT REGARDING FEDERALLY SPONSORED RESEARCH AND DEVELOPMENT

The U.S. Government may have certain rights in this invention pursuant to contract number N00019-06-C-0081 awarded by the Department of the Navy.

BACKGROUND OF THE INVENTION

This invention relates generally to gas turbine engine turbines and more particularly to structural members of such engines.

Gas turbine engines frequently include a stationary turbine frame (also referred to as an inter-turbine frame or turbine center frame) which provides a structural load path from bearings which support the rotating shafts of the engine to an outer casing, which forms a backbone structure of the engine. Turbine frames commonly include an annular, centrally-located hub surrounded by an annular outer ring, which are interconnected by a plurality of radially-extending struts. The turbine frame crosses the combustion gas flowpath of the turbine and is thus exposed to high temperatures in operation. Such frames are often referred to as "hot frames", in contrast to other structural members which are not exposed to the combustion gas flowpath.

To protect them from high temperatures, turbine frames are typically lined with high temperature resistant materials that isolate the frame structure from hot flow path gasses. The liner must provide total flow path coverage including the frame outer ring or case, hub structure and struts.

To protect the struts, a one-piece wraparound fairing is most common. This configuration requires the struts be separable from the frame assembly at the hub, outer ring or both to permit fairing installation over the struts. This makes installation and field maintenance difficult.

A transversely-split 360° combined fairing/nozzle arrangement is also known. This arrangement splits the fairing/nozzle assembly into forward and aft 360° ring sections allowing assembly to a one-piece frame by sandwiching the frame between forward and aft ring sections and bolting the sections together. This configuration is only suitable for passively cooled nozzle cascades.

Another known configuration is an interlocking split fairing arrangement in which forward and aft sections of individual fairing/nozzle components are sandwiched around the struts. This arrangement relies on a interlocking feature to keep the fairing halves together after assembly to the frame. This interlocking feature consumes a significant amount of physical space and is therefore not suitable for use with many frame configurations.

BRIEF SUMMARY OF THE INVENTION

These and other shortcomings of the prior art are addressed by the present invention, which provides a split fairing assembly for a turbine frame.

According to one aspect of the invention, a fairing for a structural strut in a gas turbine engine includes: (a) an inner band; (b) an outer band; (c) a hollow, airfoil-shaped vane extending between the inner and outer bands; (d) wherein the fairing is split along a generally transverse plane passing through the inner band, outer band and vane, so as to define a nose piece and a tail piece; and (e) complementary structures carried by the nose piece and the tail piece adapted to secure the nose piece and the tail piece to each other.

According to another aspect of the invention, a turbine frame assembly for a gas turbine engine includes: (a) a turbine frame including: (i) an outer ring; (ii) a hub; (ii) a plurality of struts extending between the hub and the outer ring; and (b) a two-piece strut fairing surrounding each of the struts, having: (i) an inner band; (ii) an outer band; and (iii) a hollow, airfoil-shaped vane extending between the inner and outer bands, wherein the strut fairing is split along a generally transverse plane passing through the inner band, outer band and vane, so as to define a nose piece and a tail piece; and (iv) complementary structures carried by the nose piece and the tail piece adapted to secure the nose piece and the tail piece to each other.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
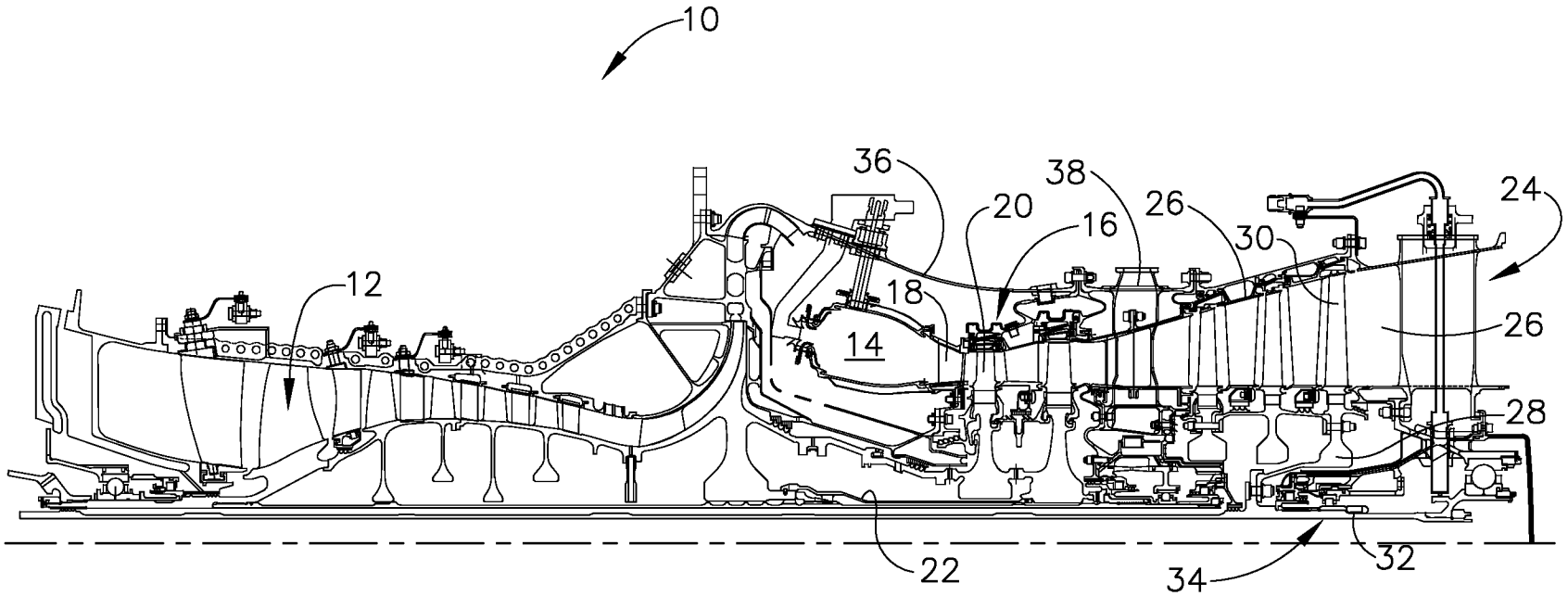
FIG. 1 is a schematic half-sectional view of a gas turbine engine constructed in accordance with an aspect of the present invention.
Figure 2A:
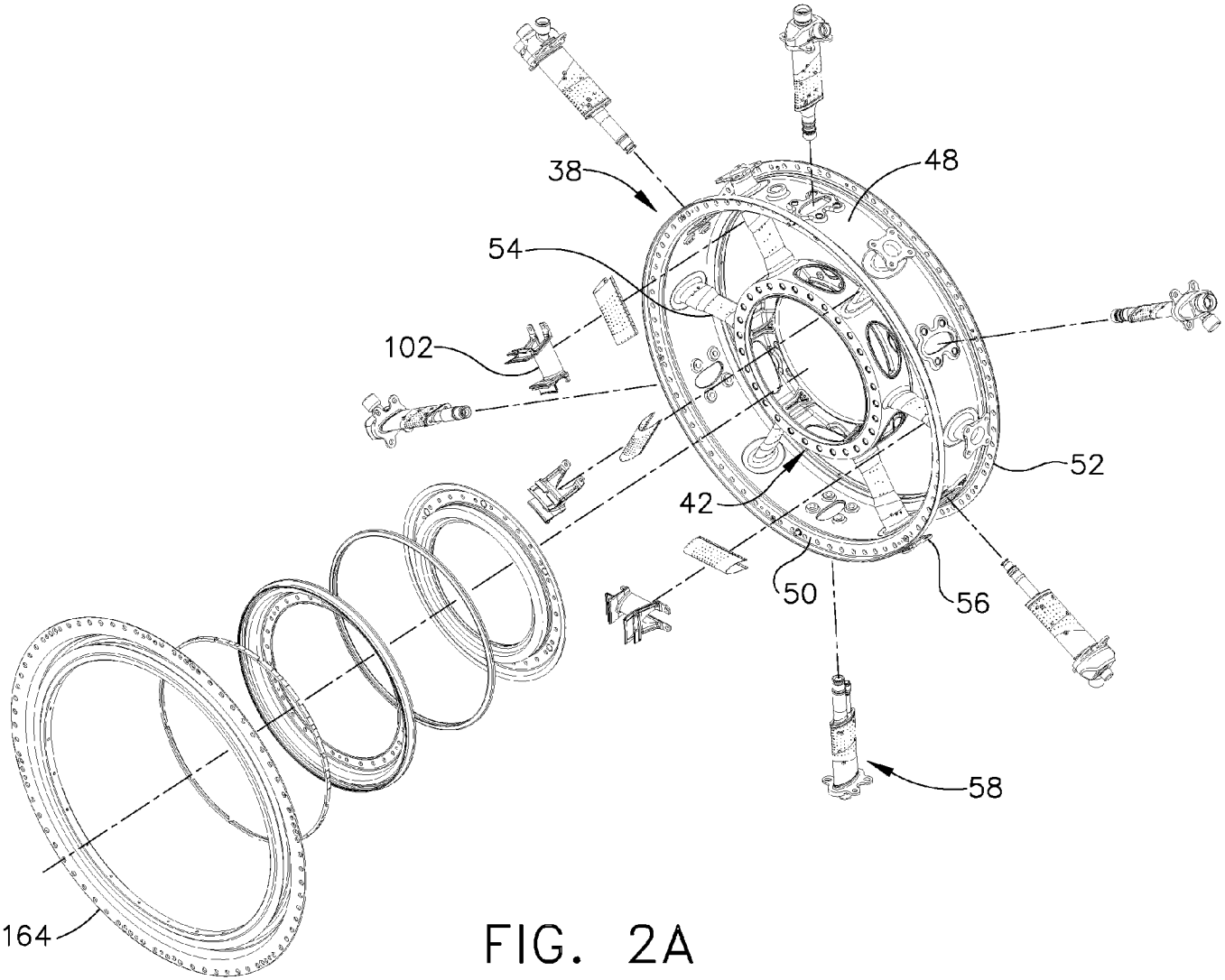
FIGS. 2A and 2B are an exploded perspective view of a turbine frame assembly of the gas turbine engine of FIG. 1.
Figure 2B:
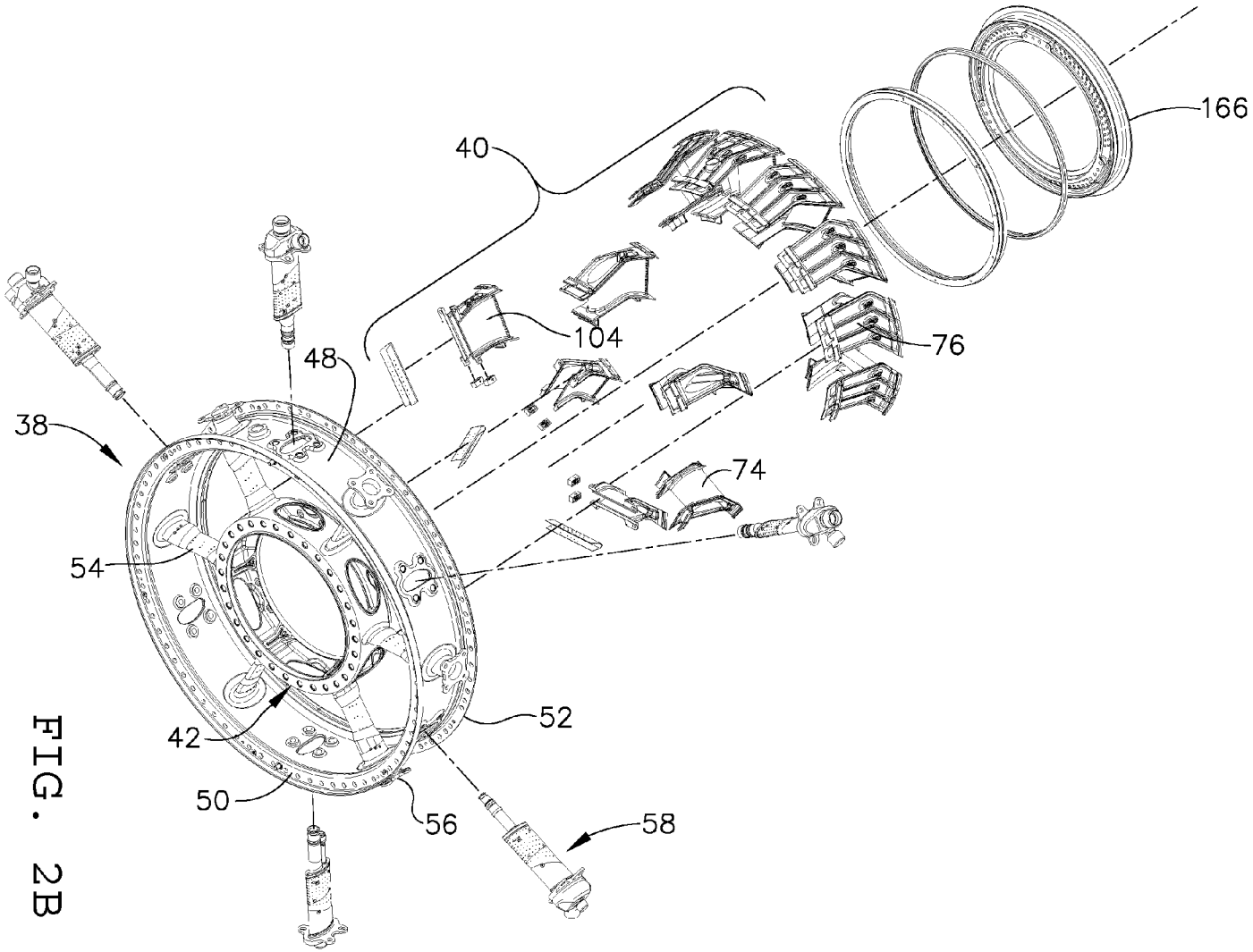

Referring to the drawings wherein identical reference numerals denote the same elements throughout the various views, FIGS. 1 and 2 depict a portion of a gas turbine engine 10 having, among other structures, a compressor 12, a combustor 14, and a gas generator turbine 16. In the illustrated example, the engine is a turboshaft engine. However, the principles described herein are equally applicable to turboprop, turbojet, and turbofan engines, as well as turbine engines used for other vehicles or in stationary applications.

The compressor 12 provides compressed air that passes into the combustor 14 where fuel is introduced and burned to generate hot combustion gases. The combustion gases are discharged to the gas generator turbine 16 which comprises alternating rows of stationary vanes or nozzles 18 and rotating blades or buckets 20. The combustion gases are expanded therein and energy is extracted to drive the compressor 12 through an outer shaft 22.

A work turbine 24 is disposed downstream of the gas generator turbine 16. It also comprises alternating rows of stationary vanes or nozzles 26 and rotors 28 carrying rotating blades or buckets 30. The work turbine 24 further expands the combustion gases and extracts energy to drive an external load (such as a propeller or gearbox) through an inner shaft 32.

The inner and outer shafts 32 and 22 are supported for rotation in one or more bearings 34. One or more turbine frames provide structural load paths from the bearings 34 to an outer casing 36, which forms a backbone structure of the engine 10. In particular, a turbine frame assembly, which comprises a turbine frame 38 that integrates a first stage nozzle cascade 40 of the work turbine 24, is disposed between the gas generator turbine 16 and the work turbine 24.

Figure 3A:
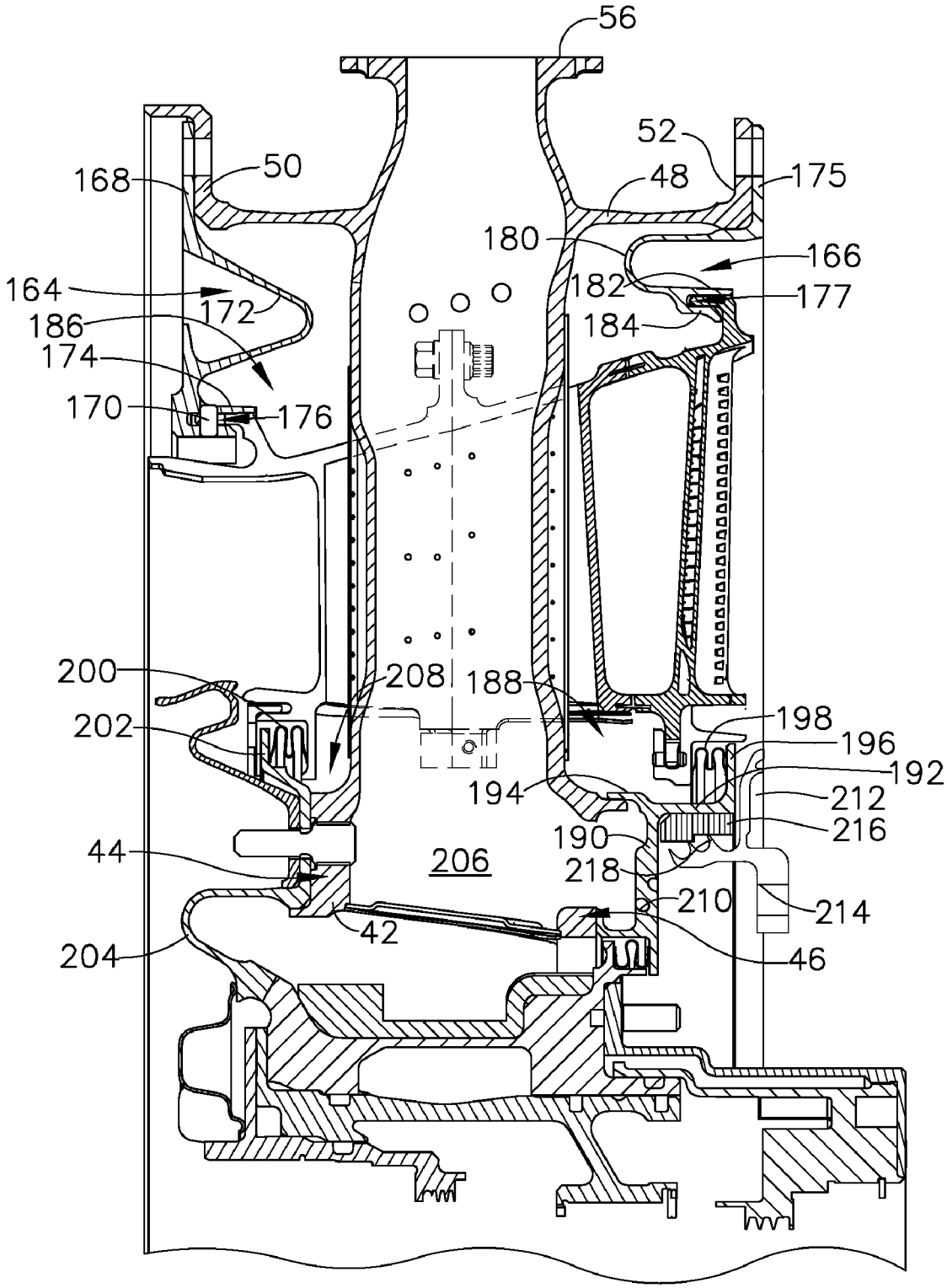
FIGS. 3A and 3B are cross-sectional views of the turbine frame assembly of FIG. 2.
Figure 3B:
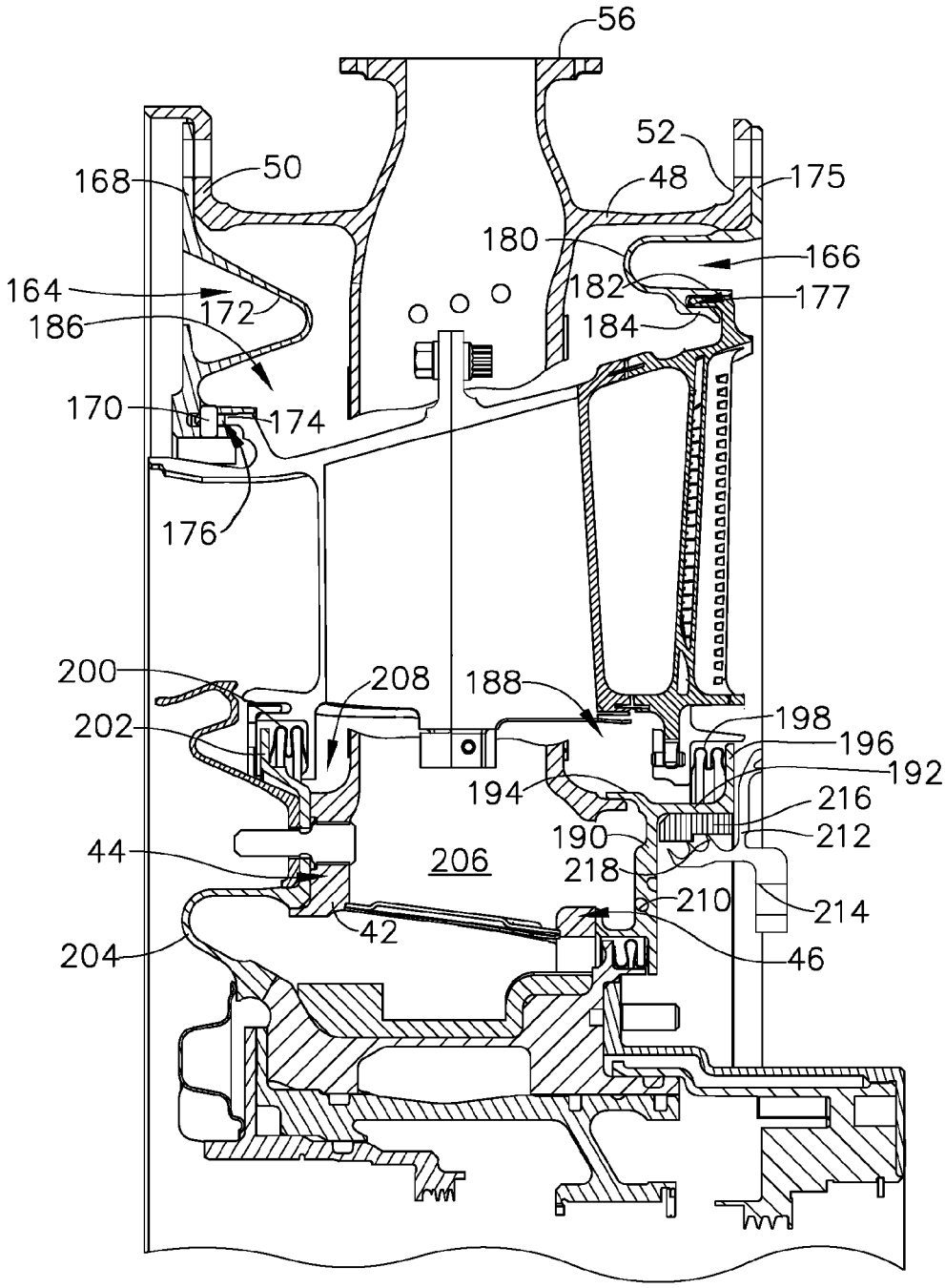
Figure 4:
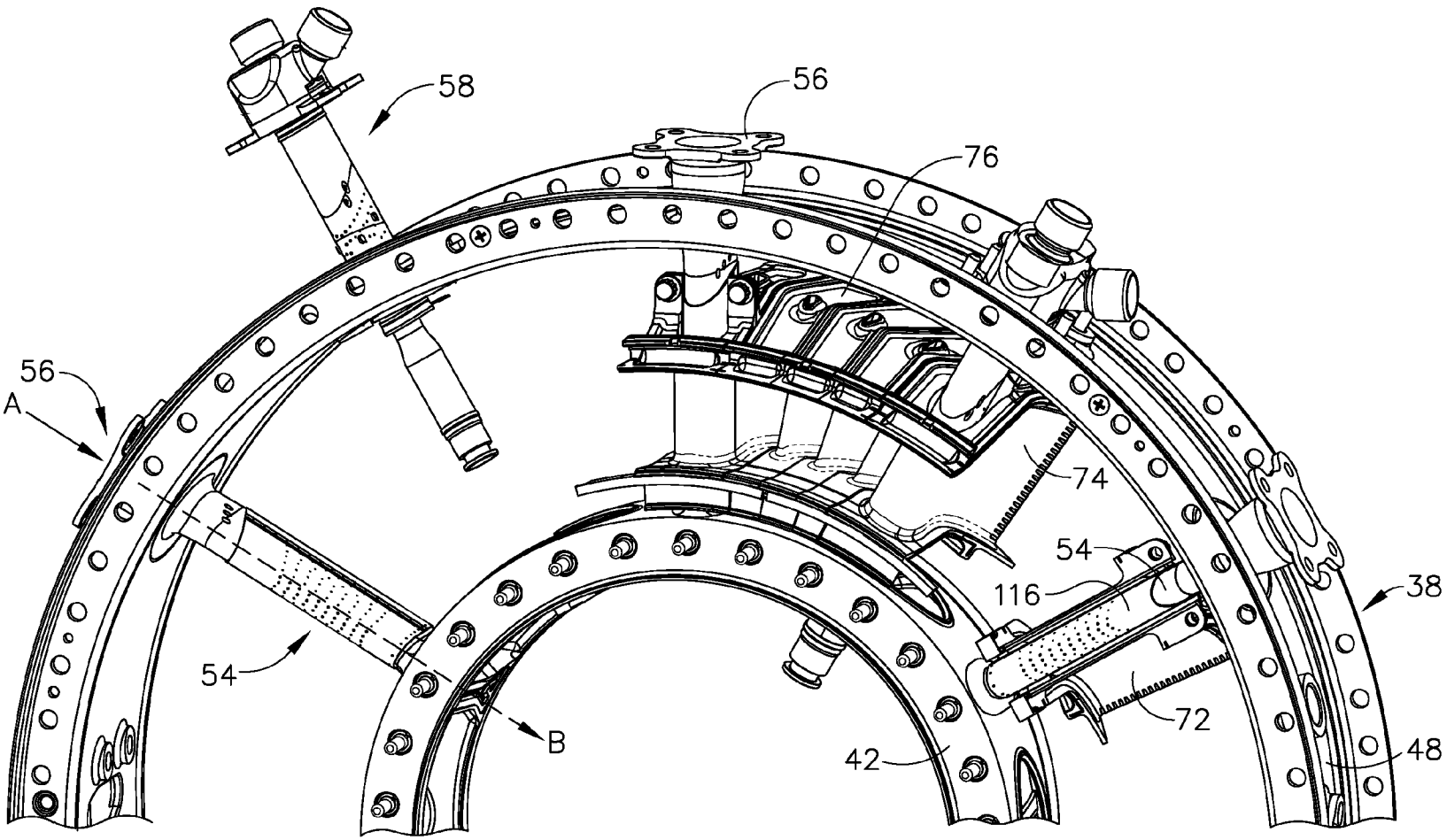
FIG. 4 is a perspective view of the turbine frame assembly in a partially-assembled condition.

FIGS. 2-4 illustrate the construction of the turbine frame assembly in more detail. The turbine frame 38 comprises an annular, centrally-located hub 42 with forward and aft faces 44 and 46, surrounded by an annular outer ring 48 having forward and aft flanges 50 and 52. The hub 42 and the outer ring 48 are interconnected by a plurality of radially-extending struts 54. In the illustrated example there are six equally-spaced struts 54. The turbine frame 38 may be a single integral unit or it may be built up from individual components. In the illustrated example it is cast in a single piece from a metal alloy suitable for high-temperature operation, such as a cobalt- or nickel-based "superalloy". An example of a suitable material is a nickel-based alloy commercially known as IN718. Each of the struts 54 is hollow and terminates in a bleed air port 56 at its outer end, outboard of the outer ring 48.

A plurality of service tube assemblies 58 are mounted in the turbine frame 38, positioned between the struts 54, and extend between the outer ring 48 and the hub 42. In this example there are six service tube assemblies 58.

The nozzle cascade 40 comprises a plurality of actively-cooled airfoils. In this particular example there are 48 airfoils in total. This number may be varied to suit a particular application. Some of the airfoils, in this case 12, are axially elongated and are incorporated into fairings (see FIG. 4) which protect the struts 54 and service tube assemblies 58 from hot combustion gases. Some of the fairings, in this case 6, are strut fairings 72 which are of a split configuration. The remainder of the fairings are service tube fairings 74 which are a single piece configuration. The remaining airfoils, in this case 36, are arranged into nozzle segments 76 having one or more vanes each.

For the purposes of the present invention only the strut fairings 72 will be described in detail. The other components of the nozzle cascade 40 are described in co-pending application by J. A. Manteiga et al. entitled "Turbine Frame Assembly and Method for a Gas Turbine Engine", which is which is incorporated herein by reference.

Figure 5:
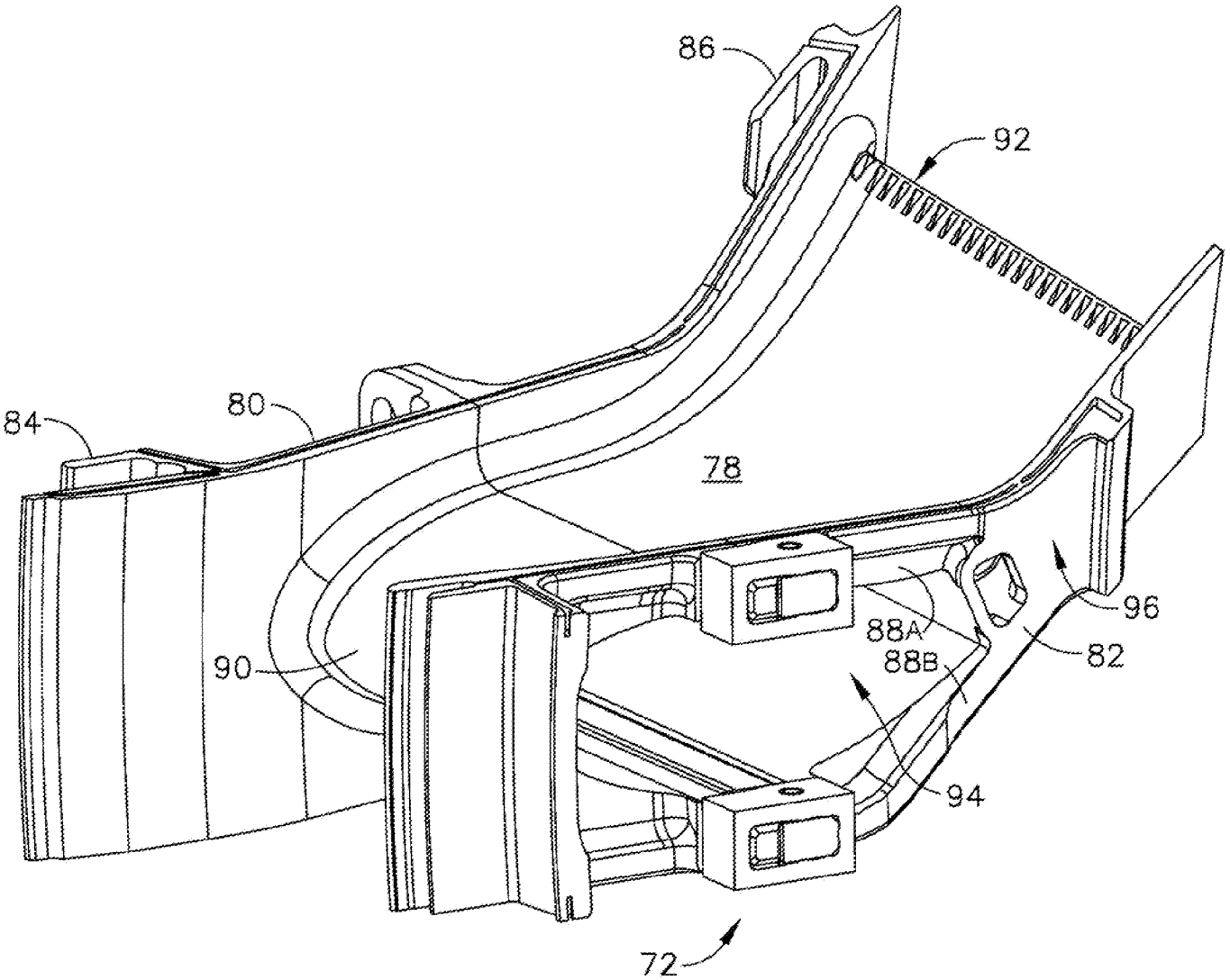
FIG. 5 is a perspective view of a strut fairing constructed according to an aspect of the present invention.

A shown in FIG. 5, each strut fairing 72 includes an airfoil-shaped vane 78 that is supported between an arcuate outer band 80 and an arcuate inner band 82. The inner and outer bands 82 and 80 are axially elongated and shaped so that they define a portion of the flowpath through the turbine frame 38. A forward hook 84 protrudes axially forward from the outer face of the outer band 80, and an aft hook 86 protrudes axially forward from the outer face of the outer band 80.

The vane 78 is axially elongated and includes spaced-apart sidewalls 88A and 88B extending between a leading edge 90 and a trailing edge 92. The sidewalls 88A and 88B are shaped so as to form an aerodynamic fairing for the strut 54 (see FIG. 4). A forward section 94 of the vane 78 is hollow and is impingement cooled, in a manner described in more detail below. An aft section 96 of the vane 78 is also hollow and incorporates walls 98 that define a multiple-pass serpentine flowpath (see FIG. 6). A plurality of trailing edge passages 100, such as slots or holes, pass through the trailing edge 92.

Figure 7:
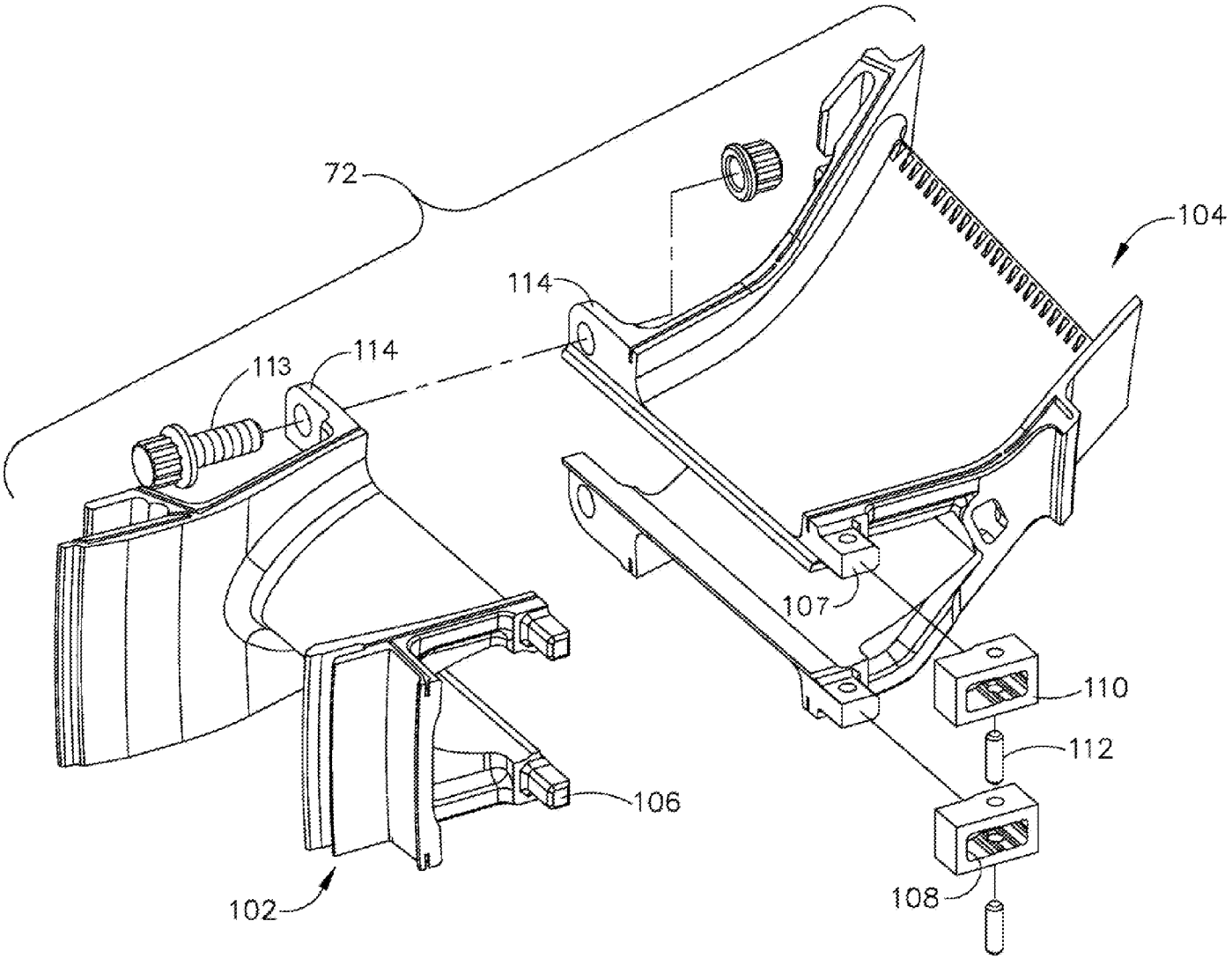
FIG. 7 is an exploded view of the strut fairing of FIG. 5.

The components of the strut fairing 72, including the inner band 82, outer band 80, and vane 78 are split, generally along a common transverse plane, so that the strut fairing 72 has a nose piece 102 and a tail piece 104 (see FIG. 7). Each of the sidewalls 88A and 88B is divided into forward and aft portions.

The interior lateral spacing between the sidewalls 88A and 88B is selected such that the nose piece 102 can slide axially over the strut 54 from forward to aft, and the tail piece 104 can slide axially over the strut 54 from aft to forward. This permits installation or removal of the nose piece 102 or tail piece 104 without disassembly of the turbine frame 38 or removal of the strut 54. This is true even if the hub 42 or outer ring 48 have large overhangs in the axial direction. The inner lateral interior surfaces of the sidewalls 88A and 88B are substantially free of any protuberances, hooks, bosses, or other features that would interfere with the free axial sliding.

The mating faces 120 and 122 of the nose piece 102 and the tail piece 104 may have a shape that is at least partially non-planar as a means of blocking leakage of cooling air or ingestion of hot flowpath gases. In the example shown, the mating surfaces 120 and 122 define a splitline that has a planar portion 124 and an "S"-shaped portion 126. Other profiles could be used, and if desired a sealing element such as a metallic strip (not shown) could be placed between the mating faces 120 and 122.

Figure 8:
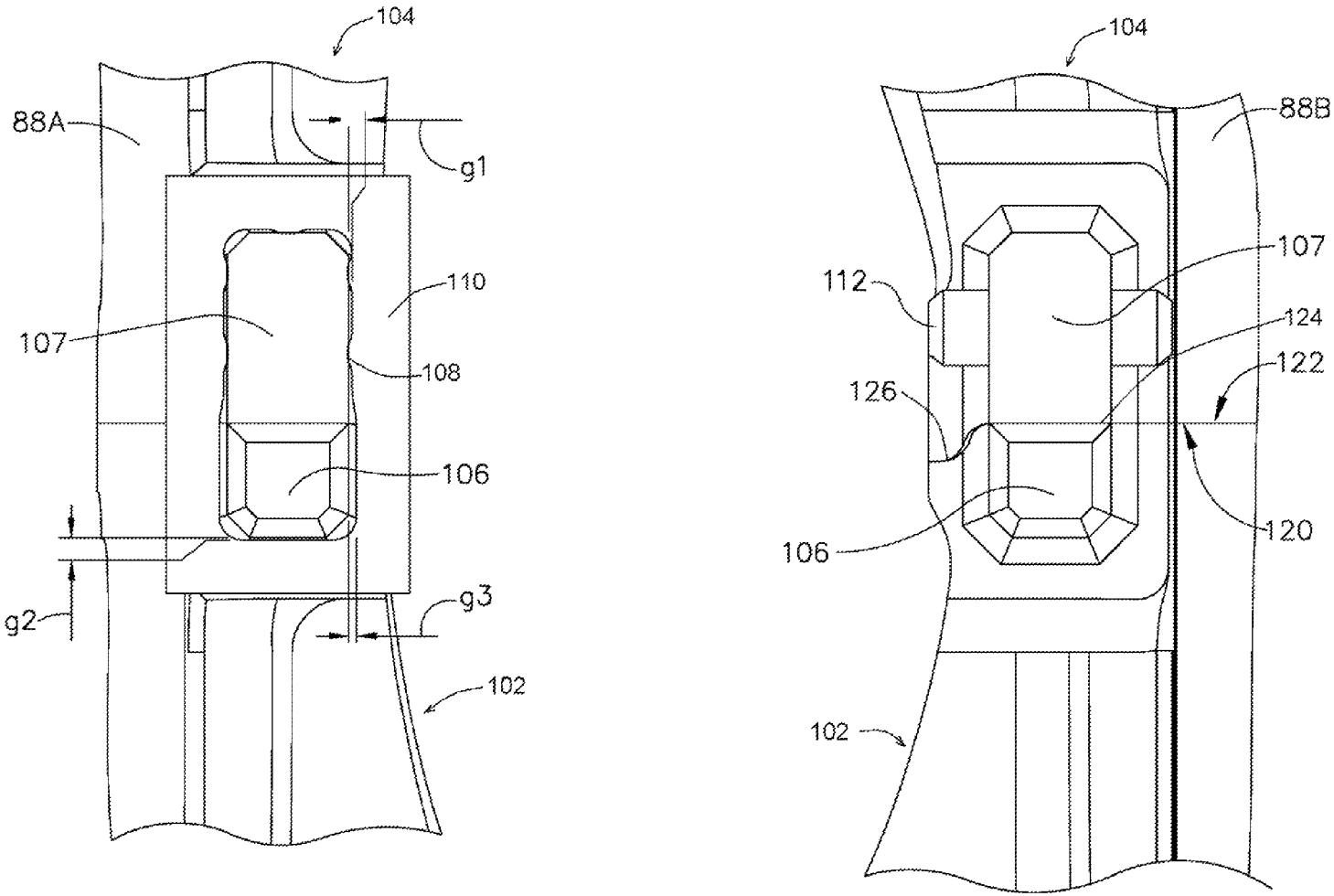
FIG. 8 is a view looking radially outward at a portion of the strut fairing of FIG. 5.

Means are provided for securing the nose piece and the tail piece 102 and 104 to each other after they are placed around a strut 54. In the illustrated example, the nose piece 102 includes tabs 106 which extend radially inward from its aft face 120, and the tail piece 104 includes tabs 107 which extend radially inward from its forward face 122. When assembled, the tabs 106 and 107 are received in a slot 108 of a metallic buckle 110. As shown in FIG. 8, the buckle 110 is generally rectangular, as is the slot 108. The slot 108 and the tabs 106 and 107 are sized so as to result in a small lateral gap "g1", for example about 0.076 mm (3 mils) between the tabs 107 of the tail piece 104 and the sides of the slot 108, and also a similar size axial gap "g2" between the assembled tabs 106 and 107 and the ends of the slot 108. The gap 108 is enlarged at its forward end to result in a slightly larger lateral gap "g3", for example about 0.254 mm (10 mils), between tabs 106 of the nose piece 102 and the sides of the slot 108. The buckle 110 is secured to the tabs 107, for example by brazing, and is optionally further secured by a press-fit pin 112 passing therethrough. The radially outer ends of the nose and tail pieces 102 and 104 are secured together with shear bolts 113 or other similar fasteners installed through mating flanges 114. As shown in FIG. 4, a strut baffle 116 pierced with impingement cooling holes is installed between the strut 54 and the strut fairing 72.

For assembly purposes, the buckles 110 may be first secured to the tabs 107 as described above then, the tail piece 104 is slipped axially forward over the strut 54 and strut baffle 116. This is done in conjunction with the installation of the service tube fairings 74 and the nozzle segments 76. Next, the nose piece 102 is slipped axially rearward over the strut 54 and strut baffle 116 and pivoted so the tabs 106 engage the slots 108. Finally, the shear bolts 113 can be installed.

The nose pieces 102 and tail pieces 104 are cast from a metal alloy suitable for high-temperature operation, such as a cobalt- or nickel-based "superalloy", and may be cast with a specific crystal structure, such as directionally-solidified (DS) or single-crystal (SX), in a known manner. An example of one suitable material is a nickel-based alloy commercially known as RENE N4.

Referring back to FIGS. 2A, 2B, 3A, and 3B, a forward nozzle hanger 164 is generally disk-shaped and includes an outer flange 168 and an inner flange 170, interconnected by an aft-extending arm 172 having a generally "V"-shaped cross-section. The inner flange 170 defines a mounting rail 174 with a slot 176 which accepts the forward hooks 84 of the strut fairings 72, as well as similar hooks of the service tube fairings 74 and nozzle segments 76. The outer flange 168 has bolt holes therein corresponding to bolt holes in the forward flange 50 of the turbine frame 38. The forward nozzle hanger 164 supports the nozzle cascade 40 radially in a way that allows compliance in the axial direction.

An aft nozzle hanger 166 is generally disk-shaped and includes an outer flange 175 and an inner flange 177, interconnected by forward-extending arm 180 having a generally "U"-shaped cross-section. The inner flange 177 defines a mounting rail 182 with a slot 184 which accepts the aft hooks 86 of the strut fairings 72, as well as similar hooks of the service tube fairings 74 and nozzle segments 76. The outer flange 175 has bolt holes therein corresponding to bolt holes in the aft flange 52 of the turbine frame 38. The aft nozzle hanger 166 supports the nozzle cascade 40 radially while providing restraint in the axial direction.

When assembled, outer bands of the strut fairings 72, service tube fairings 74, and nozzle segments 76 cooperate with the outer ring 48 of the turbine frame 38 to define an annular outer band cavity 186.

An annular outer balance piston (OPB) seal 188 is attached to the aft face of the hub 42, for example with bolts or other suitable fasteners. The OBP seal 188 has a generally "L"-shaped cross-section with a radial arm 190 and an axial arm 192. A forward sealing lip 194 bears against the hub 42, and an aft, radially-outwardly-extending sealing lip 196 captures an annular, "M"-shaped seal 198 against the nozzle cascade 40. A similar "M"-shaped seal 200 is captured between the forward end of the nozzle cascade 40 and another sealing lip 202 on an stationary engine structure 204. Collectively, the hub 42 and the OBP seal 188 define an inner manifold 206 which communicates with the interior of the hub 42. Also, inner bands of the strut fairings 72, service tube fairings 74, and nozzle segments 76 cooperate with the hub 42 of the turbine frame 38, the OBP seal 188, and the seals 198 and 200 to define an annular inner band cavity 208. One or more cooling holes 210 pass through the radial arm 190 of the OBP seal 188. In operation, these cooling holes 210 pass cooling air from the hub 42 to an annular seal plate 212 mounted on a front face of the downstream rotor 28. The cooling air enters a hole 214 in the seal plate 212 and is then routed to the rotor 28 in a conventional fashion.

The axial arm 192 of the OBP seal 188 carries an abradable material 216 (such as a metallic honeycomb) which mates with a seal tooth 218 of the seal plate 212.

Figure 6:
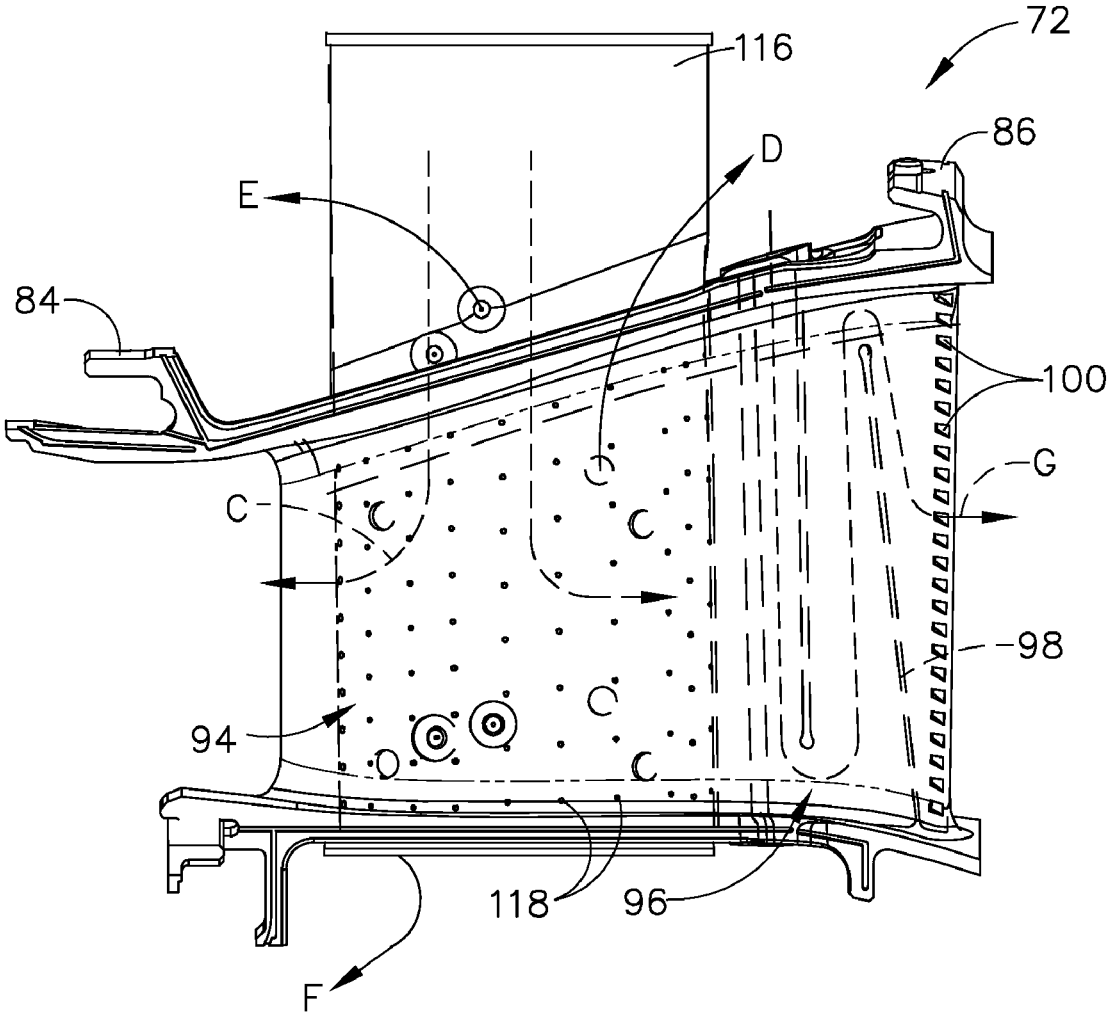
FIG. 6 is a side view of the strut fairing of FIG. 5.

Referring to FIGS. 4 and 6, cooling of the strut fairings 72 is as follows. Cooling air bled from a source such as the compressor 12 (see FIG. 1) is fed into the bleed air ports 56 and down through the struts 54, as shown by the arrow "A". A portion of the air entering the struts 54 passes all the way through the struts 54 and to the hub 42, as shown at "B". It then passes to the inner manifold 206 and subsequently to the downstream turbine rotor 28, as described above.

Another portion of the air entering the struts 54 exits passages in the sides of the struts 54 and enters the strut baffles 116. One portion of this flow exits impingement cooling holes 118 in the strut baffles 116 and is used for impingement cooling the strut fairings 72, as shown by arrows "C" (see FIG. 6). After impingement cooling, the air passes to the outer band cavity 186, as shown at "D". Another portion of air exits the strut baffles 116 and enters the outer band cavity 186 directly, as shown by arrows "E". Finally, a third portion of the air from the strut baffles 116 exits the between the strut baffle 116 and the strut 54 and purges the inner band cavity 208 (see arrow "F"). A similar cooling air flow pattern is implemented for the service tube assemblies 58 and cooling of the service tube fairings 74.

Air from the outer band cavity 186, which is as combination of purge air and post-impingement flows denoted D and E in FIG. 6, enters the serpentine passages in the aft sections of the vanes 78, as shown at arrows "G". It is then used therein for convective cooling in a conventional manner and subsequently exhausted through the trailing edge cooling passages 100.

The split fairing configuration described herein has several advantages over conventional one-piece wrapped fairing designs. It permits use of integrated turbine frames. This provides a significant initial frame cost advantage, as attachments of non-integrated frame components require expensive matched machining, assembly methods and special fasteners.

The "tab and buckle" feature of the strut fairing 72 also requires very little radial frame height to assemble making it adaptable to most integrated frame assemblies. The "tab and buckle" feature also permits fastening the fairing halves without wrench access to the inner ends of the strut fairings 72. This is a significant packaging advantage. Additionally the elimination of an interlocking feature saves significant vane width which allows thinner, high performance, fairing airfoils as compared to an interlocking design.

Finally, the invention improves removal and replacement assembly time of damaged flow path components by reducing the amount of required collateral frame/liner component disassembly required.

The foregoing has described a split fairing for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A fairing for a structural strut in a gas turbine engine, comprising:
   (a) an inner band;
   (b) an outer band;
   (c) a hollow, airfoil-shaped vane extending between the inner and outer bands;
   (d) wherein the fairing is split along a generally transverse plane passing through the inner band, outer band and vane, so as to define a nose piece and a tail piece, wherein the vane is defined by a pair of spaced-apart sidewalls extending between a leading edge and a trailing edge each of the sidewalls being split into forward and aft portions by the generally transverse plane, and wherein each of the sidewall portions carries a radially-inwardly extending tab, the tabs positioned such that pairs of the tabs lie adjacent to each other when the nose piece and tail piece are in an assembled condition;
   (e) complementary structures carried by the nose piece and the tail piece adapted to secure the nose piece and the tail piece to each other; and
   (f) a slotted buckle which surrounds and clamps together pairs of the tabs.

2. The fairing of claim 1 wherein a pin passes through the buckle and at least one of the tabs.

3. A fairing for a structural strut in a gas turbine engine, comprising:
   (a) an inner band;
   (b) an outer band;
   (c) a hollow, airfoil-shaped vane extending between the inner and outer bands;
   (d) wherein the fairing is split along a generally transverse plane passing through the inner band, outer band and vane, so as to define a nose piece and a tail piece, wherein the vane is defined by a pair of spaced-apart sidewalls extending between a leading edge and a trailing edge each of the sidewalls being split into forward and aft portions by the generally transverse plane, wherein mating surfaces of the sidewalls have a non-planar shape; and (e) complementary structures carried by the nose piece and the tail piece adapted to secure the nose piece and the tail piece to each other.

4. The fairing of claim 1 wherein the nose piece and the tail piece carry mating flanges adapted to be coupled together by one or more fasteners.

5. The fairing of claim 1 wherein an aft section of the vane includes walls defining a serpentine flow path therein, the serpentine flow path in fluid communication with at least one trailing edge passage disposed at a trailing edge of the vane.

6. The fairing of claim 1 wherein the nose piece and the tail piece are cast from a metallic alloy.

7. A turbine frame assembly for a gas turbine engine, comprising:

(a) a turbine frame including:

(i) an outer ring;

(ii) a hub;

(ii) a plurality of struts extending between the hub and the outer ring; and (b) a two-piece strut fairing surrounding each of the struts, comprising:

(i) an inner band;

(ii) an outer band; and (iii) a hollow, airfoil-shaped vane extending between the inner and outer bands, wherein the strut fairing is split along a generally transverse plane passing through the inner band, outer band and vane, so as to define a nose piece and a tail piece, wherein the vane is defined by a pair of spaced-apart sidewalls extending between a leading edge and a trailing edge, each of the sidewalls being split into forward and aft portions by the transverse plan, and wherein each of the sidewall portions carries a radially-inwardly extending tab, the tabs positioned such that pairs of the tabs lie adjacent to each other when the nose piece and tail piece are in an assembled condition; and (iv) complementary structures carried by the nose piece and the tail piece adapted to secure the nose piece and the tail piece to each other;

(c) a slotted buckle which surrounds and clamps together pairs of the tabs.

8. The turbine frame assembly of claim 7 wherein the outer ring, the hub, and the struts are a single integral casting.

9. The turbine frame assembly of claim 7 further comprising a strut baffle pierced with impingement cooling holes disposed between each of the struts and the vane of the associated strut fairing.

10. The turbine frame assembly of claim 7 wherein a pin passes through the buckle and one of the tabs.

11. A turbine frame assembly for a gas turbine engine, comprising:

(a) a turbine frame including:

(i) an outer ring;

(ii) a hub;

(ii) a plurality of struts extending between the hub and the outer ring; and (b) a two-piece strut fairing surrounding each of the struts, comprising:

(i) an inner band;

(ii) an outer band; and (iii) a hollow, airfoil-shaped vane extending between the inner and outer bands, wherein the strut fairing is split along a generally transverse plane passing through the inner band, outer band and vane, so as to define a nose piece and a tail piece, and wherein the vane is defined by a pair of spaced-apart sidewalls extending between a leading edge and a trailing edge, each of the sidewalls being split into forward and aft portions by the transverse plane; and (iv) complementary structures carried by the nose piece and the tail piece adapted to secure the nose piece and the tail piece to each other, wherein mating surfaces of the sidewalls have a non-planar shape.

12. The turbine frame assembly of claim 7 wherein the nose piece and the tail piece carry mating flanges adapted to be coupled together by one or more fasteners.

13. The turbine frame assembly of claim 7 wherein an aft section of the vane includes walls defining a serpentine flow path therein, the serpentine flow path in fluid communication with at least one trailing edge passage disposed at a trailing edge of the vane.

14. The turbine frame assembly of claim 7 wherein the nose piece and the tail piece are cast from a metallic alloy.

15. A turbine frame assembly for a gas turbine engine, comprising:

(a) a turbine frame including:

(i) an outer ring;

(ii) a hub;

(ii) a plurality of struts extending between the hub and the outer ring; and (b) a two-piece strut fairing surrounding each of the struts, comprising:

(i) an inner band;

(ii) an outer band; and (iii) a hollow, airfoil-shaped vane extending between the inner and outer bands, wherein the strut fairing is split along a generally transverse plane passing through the inner band, outer band and vane, so as to define a nose piece and a tail piece; and (iv) complementary structures carried by the nose piece and the tail piece adapted to secure the nose piece and the tail piece to each other, wherein the strut fairings are secured to the turbine frame by spaced-apart annular forward and aft nozzle hangers which engage the outer bands of the strut fairings.

* * * * *